US006213718B1

(12) United States Patent
Hill et al.

(10) Patent No.: US 6,213,718 B1
(45) Date of Patent: Apr. 10, 2001

(54) AIR CIRCULATION FAN WITH REMOVABLE SHROUD

(75) Inventors: D. Lee Hill, Olathe; Hamid Massali, Leawood, both of KS (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/067,774

(22) Filed: Apr. 27, 1998

(51) Int. Cl.[7] ..... F04D 29/70

(52) U.S. Cl. ..... 416/146 R; 416/247 R

(58) Field of Search ..... 416/247 R, 189, 416/190, 191, 146 R; 415/121.2, 185, 186, 189, 208.1, 208.2, 208.3, 208.5, 211.2, 209.2, 211.1, 214.1, 912

(56) References Cited

U.S. PATENT DOCUMENTS

| | | | | |
|---|---|---|---|---|
| 759,951 | | 5/1904 | Winch . | |
| 1,751,793 | | 3/1930 | Cook . | |
| 2,536,130 | | 1/1951 | Herrman . | |
| 2,554,601 | | 5/1951 | Sutton . | |
| 2,711,165 | | 6/1955 | Leavenworth . | |
| 2,763,428 | | 9/1956 | Selah . | |
| 2,812,900 | | 11/1957 | Matthews . | |
| 2,923,463 | | 2/1960 | Shunkwiler . | |
| 2,972,956 | | 2/1961 | Newton . | |
| 3,111,173 | | 11/1963 | Klonoski . | |
| 3,144,859 | | 8/1964 | Walton . | |
| 3,261,544 | | 7/1966 | Guichard . | |
| 3,575,527 | | 4/1971 | Watanabe . | |
| 3,583,659 | | 6/1971 | Lermuslaux . | |
| 3,787,142 | * | 1/1974 | Dupke | 416/247 R |
| 3,976,393 | * | 8/1976 | Larson | 415/119 |
| 4,018,297 | * | 4/1977 | Haupt | 180/54 A |
| 4,022,548 | | 5/1977 | McLarty . | |
| 4,073,597 | * | 2/1978 | Barnhart et al. | 415/201 |
| 4,140,433 | | 2/1979 | Eckel . | |
| 4,149,689 | | 4/1979 | McDonald . | |
| 4,189,281 | | 2/1980 | Katagiri et al. . | |
| 4,287,816 | | 9/1981 | Kiccard . | |
| 4,508,486 | * | 4/1985 | Tinker | 415/119 |
| 4,657,483 | | 4/1987 | Bede . | |
| 4,750,863 | | 6/1988 | Scoggins . | |
| 4,781,526 | | 11/1988 | Mead . | |
| 4,927,324 | * | 5/1990 | Coup et al. | 415/121.2 |
| 5,000,079 | * | 3/1991 | Mardis | 98/1 |
| 5,088,886 | * | 2/1992 | Hopkins | 415/119 |
| 5,094,676 | | 3/1992 | Karbacher . | |
| 5,342,175 | | 8/1994 | Patton . | |
| 5,391,056 | | 2/1995 | Wang . | |
| 5,498,134 | | 3/1996 | Ibekwe . | |
| 5,944,488 | * | 8/1999 | Matson | 416/247 R |

* cited by examiner

*Primary Examiner*—Christopher Verdier
(74) *Attorney, Agent, or Firm*—Hovey Williams Timmons & Collins

(57) ABSTRACT

An air circulation fan has front and rear fan guard members, a motor, a propeller, and a removable shroud covering an outer peripheral portion of the front fan guard member. The removable shroud forms an annular ring having a central, air discharge opening. In one embodiment, the removable shroud is formed from an integral piece of elastomeric material. In another embodiment, the shroud is formed from a plurality of identical plastic shroud portions. Each shroud portion is formed of plastic and covers a section of the outer peripheral portion of the front fan guard member. Each shroud portion has clips for clipping the portion to the front fan guard member. In one embodiment, fan blades, conventionally used on box-type fans, having an inner, leading cut-away notch and a trailing flared portion. The presence of the shroud and such blades make the fan useful in agricultural settings, such as in poultry barns. In operation of the fan, the shroud greatly reduces the noise generated by the fan.

17 Claims, 5 Drawing Sheets

AIR CIRCULATION FAN WITH REMOVABLE SHROUD

BACKGROUND OF THE INVENTION

1. Field of the Invention

The present invention is generally directed to a fan. Particularly, the present invention is directed to an air circulation fan having a shroud for enhancing fan performance.

2. Description of the Related Art

Electric fans for circulating air are widely used in commercial and industrial environments. For example, air circulation fans are commonly located at each work station in factories, such as automobile plants. In the past, operation of air circulation fans has generated a considerable amount of noise. The primary source of noise during the operation of such fans is the interaction of the tip region of each blade with moving air generated by operation of the fan. Reduction in noise levels caused by the operation of an air circulation fan is therefore desired, particularly in those environments in which a large number of such fans are utilized.

Air circulation fans have previously not been used in agricultural settings for a variety of reasons. Most notably, in agricultural settings, such as poultry barns, it is desirable to use fans which can disperse unclean air at high flow rates. Conventional air circulation fans, which utilize traditional front and rear fan guard members in the form of a grille, do not produce these desired results, and have thus been unsatisfactory for use in a poultry barn. Accordingly, box-type fans, which have a closed structure and a venturi surrounding the periphery of the fan propeller, have been widely used in agricultural settings. Box-type fans operating under adverse static pressures can produce a flow of air having a cfm valve. A distinct disadvantage, however, is that the inlet flow field pattern is purely axial which results in stagnant flow regions in areas upstream and adjacent to the fan itself. The need exists for a fan which enhances air circulation without significantly increasing the cost of the fan and noise levels as well as the complexity of its manufacture. Additionally, the need exists for an air circulator fan which is useful in an agricultural setting, such as a poultry barn. The present invention meets these needs while overcoming the drawbacks of the prior art.

SUMMARY OF THE INVENTION

An air circulation fan has front and rear fan guard members. Each front and rear fan guard member has a plurality of spaced apart ribs extending radially outward from a generally central location. A conventional grill is secured over the ribs to form a concave dish-shaped member. An outer peripheral rim is secured along the outer periphery of each guard member to an outer end portion of each radially extending rib.

Each fan guard member preferably defines a central opening. The central opening in the front fan guard member accepts a name plate, while the central opening in the rear fan guard member is preferably slightly larger than the opening in the front fan guard member, and receives a portion of an electrical motor. The motor is secured by fasteners to the rear fan guard member, and any conventional propeller or blade arrangement is attached to the electrical motor.

A plurality of selected ribs of the ribs on the front fan guard member are each bent at an outer end to form a hook.

Each hook overlaps and partially surrounds the outer peripheral rim of the rear fan guard member, thereby securing two fan guard members together. When the front fan guard member is secured to the rear fan guard member, the radially extending ribs of the respective guard members are offset from each other, to prevent the radially extending ribs of the rear fan guard member from interfering with the hook portions. It will be understood that hook members could, alternatively, or additionally, be formed on outer ends of selected ribs on the rear fan guard member.

In accordance with the principles of the invention, a removable shroud is positioned about an outer peripheral portion of the front fan guard member. The shroud forms an annular ring having a central, air discharge opening.

In one embodiment, the removable shroud is formed of an integral piece of stretchable material, such as an elastomeric material. In such an embodiment, the removable shroud forms an elastomeric band which releasably engages about an outer peripheral portion of the front fan guard member. Particularly, the shroud is stretched, and thus expands, to place it into engagement with the front fan guard member. The stretchable shroud thus securely adapts to the contour of the outer peripheral portion of the front fan guard member.

In an alternate embodiment, the removable shroud is formed of a plurality of identical shroud portions. Each shroud portion has at least one clip for clipping to the front fan guard member. In each embodiment, the central opening of the shroud preferably has a diameter which is slightly less than the diameter of an imaginary circle caused by a line of rotary movement of the outer tips of the blades of the propeller.

In operation of the fan, with the removable shroud secured to the outer peripheral portion of the front fan guard member, the noise generated by the fan is greatly reduced when compared to operation of the fan with the shroud removed. Additionally, inclusion of the shroud on the fan allows the air circulator to operate under a static pressure differential.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 2:
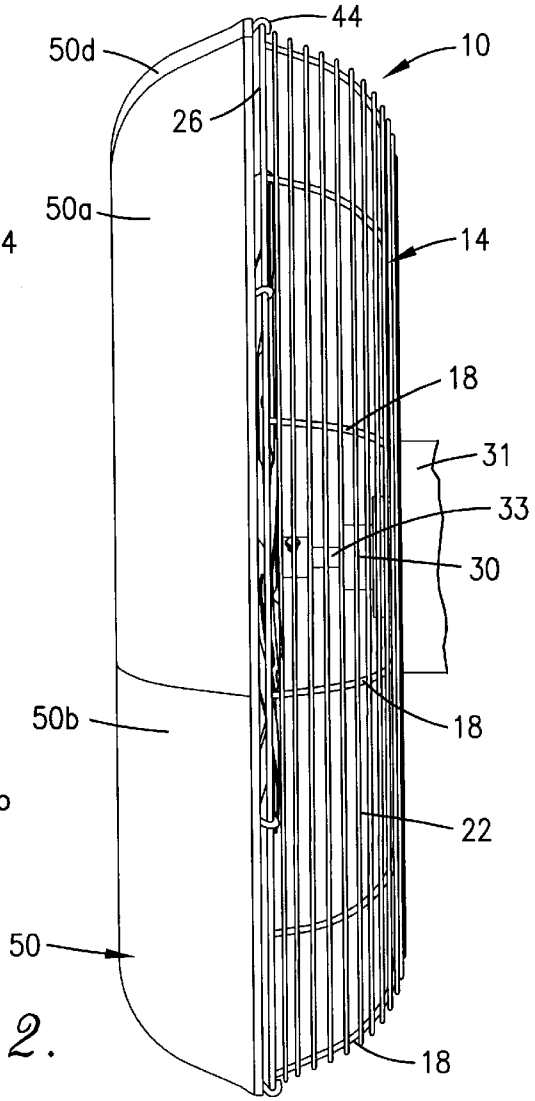
FIG. 2 is a right side view of the air circulation fan having a removable shroud in accordance with the first embodiment of the present invention.
Figure 1:
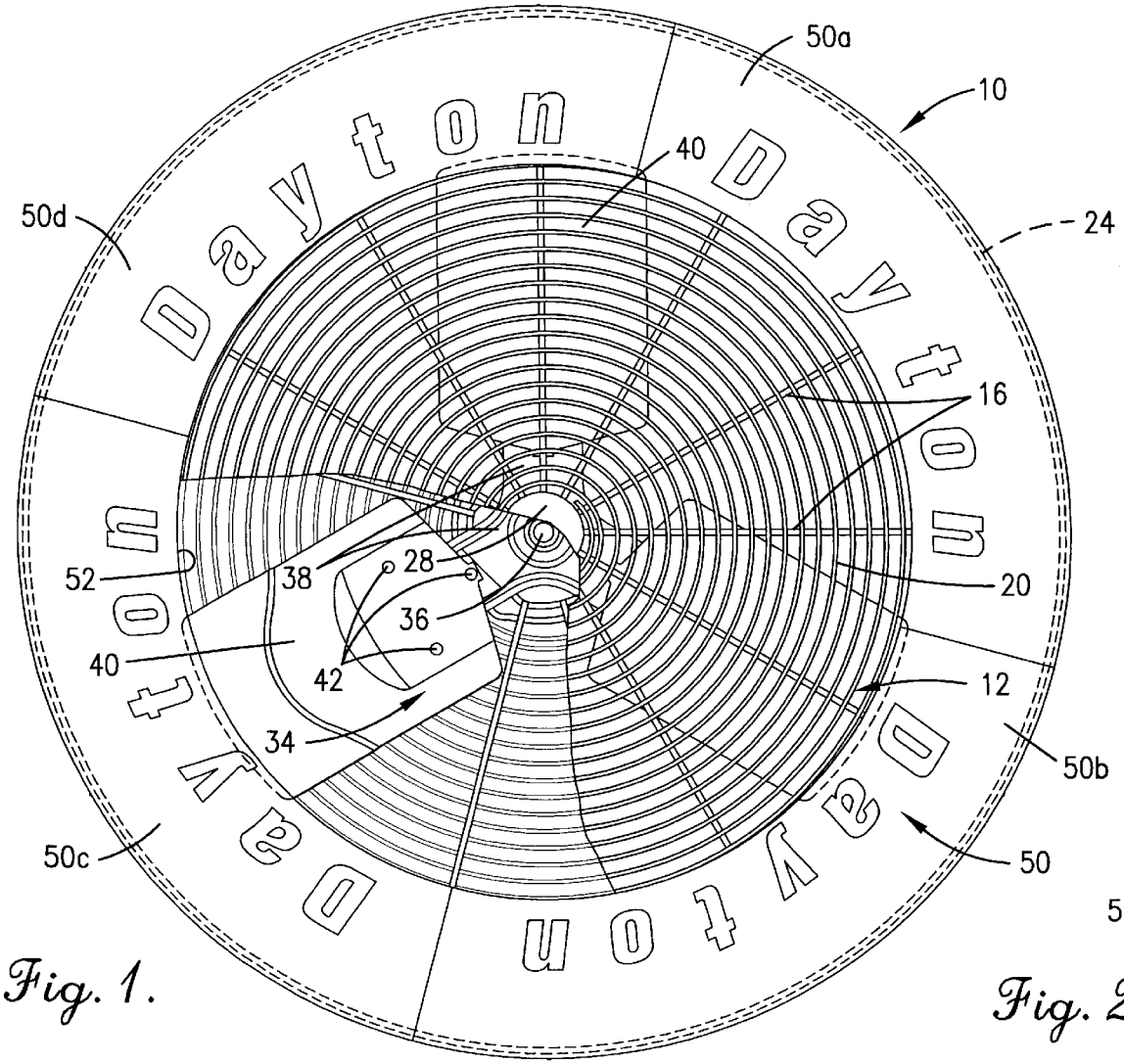
FIG. 1 is a front view of an air circulation fan having a removable shroud in accordance with a first embodiment of the present invention.

With reference to FIGS. 1 and 2, an air circulation fan of the present invention is denoted generally by reference numeral 10. As shown, air circulation fan 10 has a front fan guard member 12 and a rear fan guard member 14, each of which is preferably formed of metal. Each fan guard member 12, 14, forms a concave disc and has a plurality of respective ribs 16, 18. As illustrated, the guard is oversized, but could be any conventional size. Ribs 16, 18 extend radially outward from a generally central location, to an outer periphery of the respective guard members 12, 14. Each guard member 12, 14 has a grill, or screen, as denoted generally by the reference numeral 20, 22. The grills 20, 22 are preferably formed by spiraling a wire rod member in the manner illustrated, although the grills 20, 22 could be formed in other conventional manners, such as with concentric rings. The formation of grills 20, 22 will be readily understood by those with skill in the art. Grills 20, 22 are secured to respective ribs 16, 18 in any conventional manner, such as by welding. Each guard member 12, 14 has an outer peripheral rim 24, 26 secured to outer portions of associated ribs 16, 18.

Front fan guard member 12 defines a central opening. Particularly, front fan guard member 12 defines a central opening adapted to receive a cover, or insert 28, such as a conventional name or logo-bearing plate. Rear guard member 14 has a central aperture (not shown) for receiving an output portion 30 of an electric motor having a rotary output. The motor is preferably a one-half horsepower motor, and has a housing 31. Rear guard member 14 is secured to motor housing 31 by fasteners in any conventional manner.

A propeller, denoted generally by reference numeral 34, is secured to the output portion 30 of the motor and particularly a shaft 33 thereof, in any conventional fashion. Propeller 34 includes a conventional central hub 36 having a plurality of outwardly extending wings 38 and fan blades 40. The fan blades 40 are connected by fasteners, such as rivets 42, to respective wings 38. The described structure and arrangement of conventional fan guards, fan motors, and propellers will be readily appreciated by those with skill in the art, as will the attachment of the rear guard member 14 to the fan motor.

In the embodiment of the present invention illustrated in FIGS. 1–2, fan blades 40 are generally rectangular in shape, and are preferably of a type manufactured by Revcor, Inc., and known as a G-Series blade. Such blades are commonly used on air circulation fans.

Figure 3:
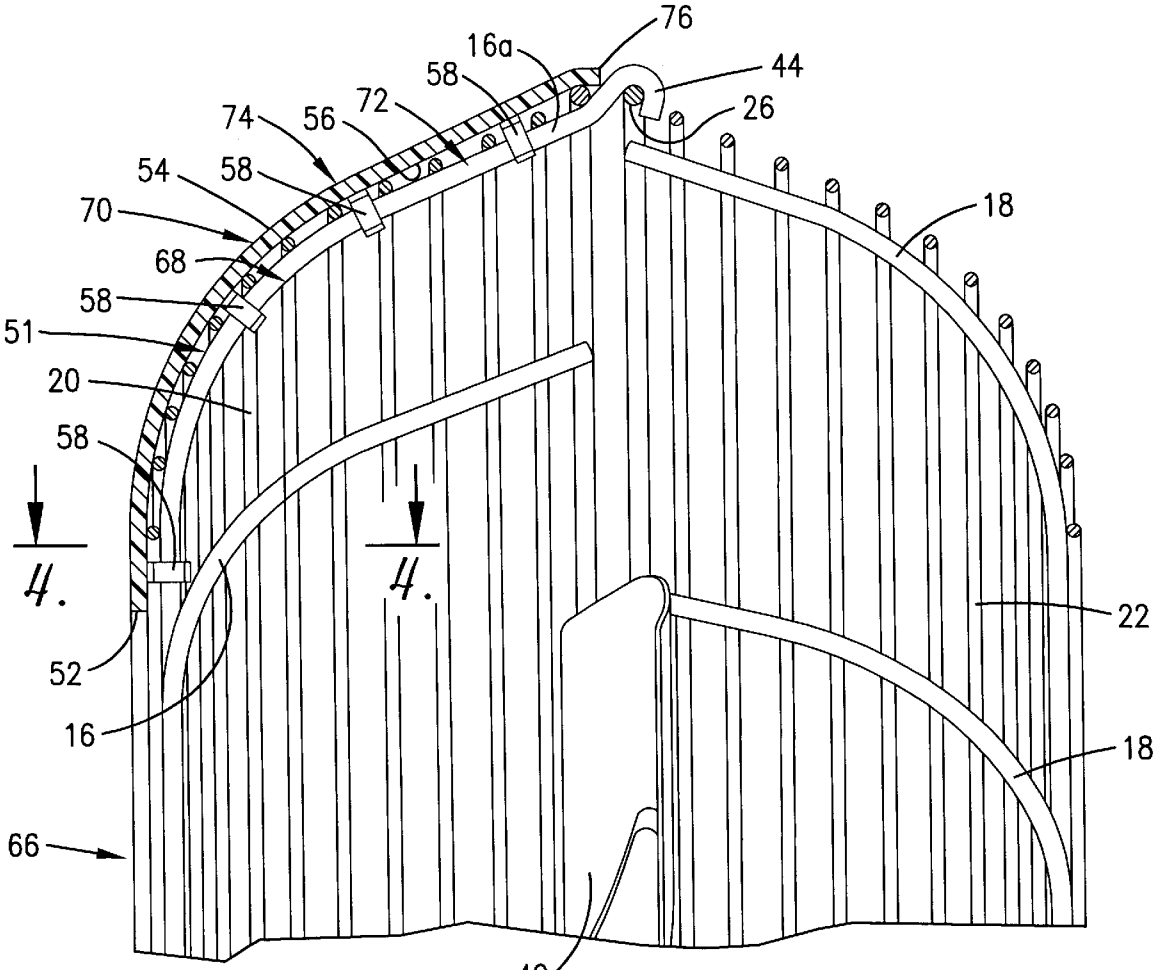
FIG. 3 is an enlarged cross-sectional view illustrating the air circulation fan having a removable shroud in accordance with the first embodiment of the invention.

With particular reference to FIGS. 2 and 3, each of a plurality of selected ribs 16*a* of front ribs 16 is bent at an outer end to form a hook, as designated by hooks 44. As illustrated, hooks 44 overlap and partially surround outer peripheral rim 26 of rear guard member 14. Hooks 44 serve to releasably secure front guard member 12 to rear guard member 14. As illustrated by FIG. 3, the position of ribs 16 on front guard member 12, and particularly those selected ribs 16*a* having a hook 44 at an outer end thereof, are offset from (e.g., not in alignment with) the ribs 18 of rear fan guard member 14. As will be readily appreciated, the offset arrangement of the ribs 16, 18 prevents ribs 18 on rear guard member 14 from interfering with hooks 44 on front guard member 12. It will be appreciated that hooks 44 could alternatively, or additionally, be located on rear guard member 14 for engaging with front guard member 12. In any such embodiment, hooks 44 at the periphery of the fan guard 10 permit guard members 12, 14 to be secured together.

Referring to FIGS. 1–4, and in accordance with a first embodiment of the present invention, air circulation fan 10 has a removable shroud 50 engaged about an outer peripheral portion of front fan guard member 12. In the embodiment illustrated in FIGS. 1–4, removable shroud 50 is formed of four separate, and identically formed shroud portions 50*a*, 50*b*, 50*c*, and 50*d*. Each removable shroud portion 50*a*–50*d* is preferably formed of rigid, or semi-rigid (e.g., partially flexible) plastic. It will be understood and appreciated that shroud 50 could be formed of a single piece of plastic material, or could be made from two halves, three thirds, etc. The removable shroud 50 forms an annular ring having a central, air discharge opening. As illustrated in FIGS. 1 and 3, the diameter of the central, air discharge opening, defined by the inner most edge 52 of removable shroud 50, is slightly less than the diameter of an imaginary circle defined by the outermost tips of blades 40 when rotating.

Figure 4:
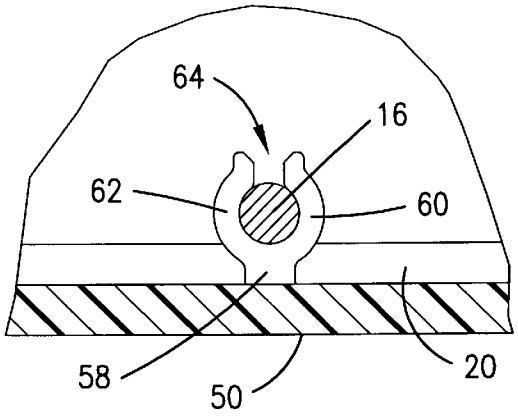
FIG. 4 is a fragmentary view taken along line 4—4 of FIG. 3.

Each shroud portion 50*a*–50*d* has a front face 54 and a rear face 56. Each shroud portion may include a layer of sound absorbing material, such as foam, applied to rear face 56. The front face 54 of removable shroud 50 provides a surface for placement of indicia, such as logos and trademarks, instructions, warnings, etc. A plurality of clips 58 are connected to, and extend outwardly from, rear face 56 of each shroud portion 50*a*–50*d*. As illustrated in FIGS. 3 and 4, each clip 58 is positioned on rear face 56 of its respective shroud portion 50*a*–50*d* so as to receive one of the ribs 16 on front fan guard 12. In this way, each shroud portion 50*a*–50*d* is releasably secured to front fan guard member 12. Particularly, as illustrated in FIG. 4, each clip 58 has a pair of outwardly extending, curved portions 60, 62 defining a channel 64 and an internal cavity. As will be appreciated, placement of each removable shroud portion 50*a*–50*d* onto front fan guard member 12 requires clipping of the clips onto ribs 16 by placing the shroud in a position so that the clips engage ribs 16 at a mouth portion thereof. As the shroud is forced onto the front fan guard member, the outwardly extending, curved portions 60, 62 bow outwardly to permit the respective rib 16 to pass through the channel 64. Once the shroud 50 is completely secured to front fan guard member 12, each rib 16 is snugly received and grasped by the various clips 58.

As illustrated in FIG. 3, the front fan guard member 12 is disc shaped with a flat face portion 66. Front fan guard member 12 has an outer peripheral portion having a convex portion 68. In accordance with an aspect of the invention, removable shroud 50 is constructed to closely engage with an outer peripheral portion 51 of the front fan guard member 12. Accordingly, each shroud portion 50*a*–50*d* itself has a concave portion 70 for overlying the convex portion of the outer peripheral portion of the fan guard member 12. Similarly, front fan guard member 12 has a generally frustoconical section 72, and the removable shroud 50 also has a frustoconical section 74 for overlying the frustoconical section 72 of the front fan guard member 12. The shroud 50 has an outer edge 76 which terminates just beyond the outer peripheral rim 24 of front fan guard member 12.

Figure 5:
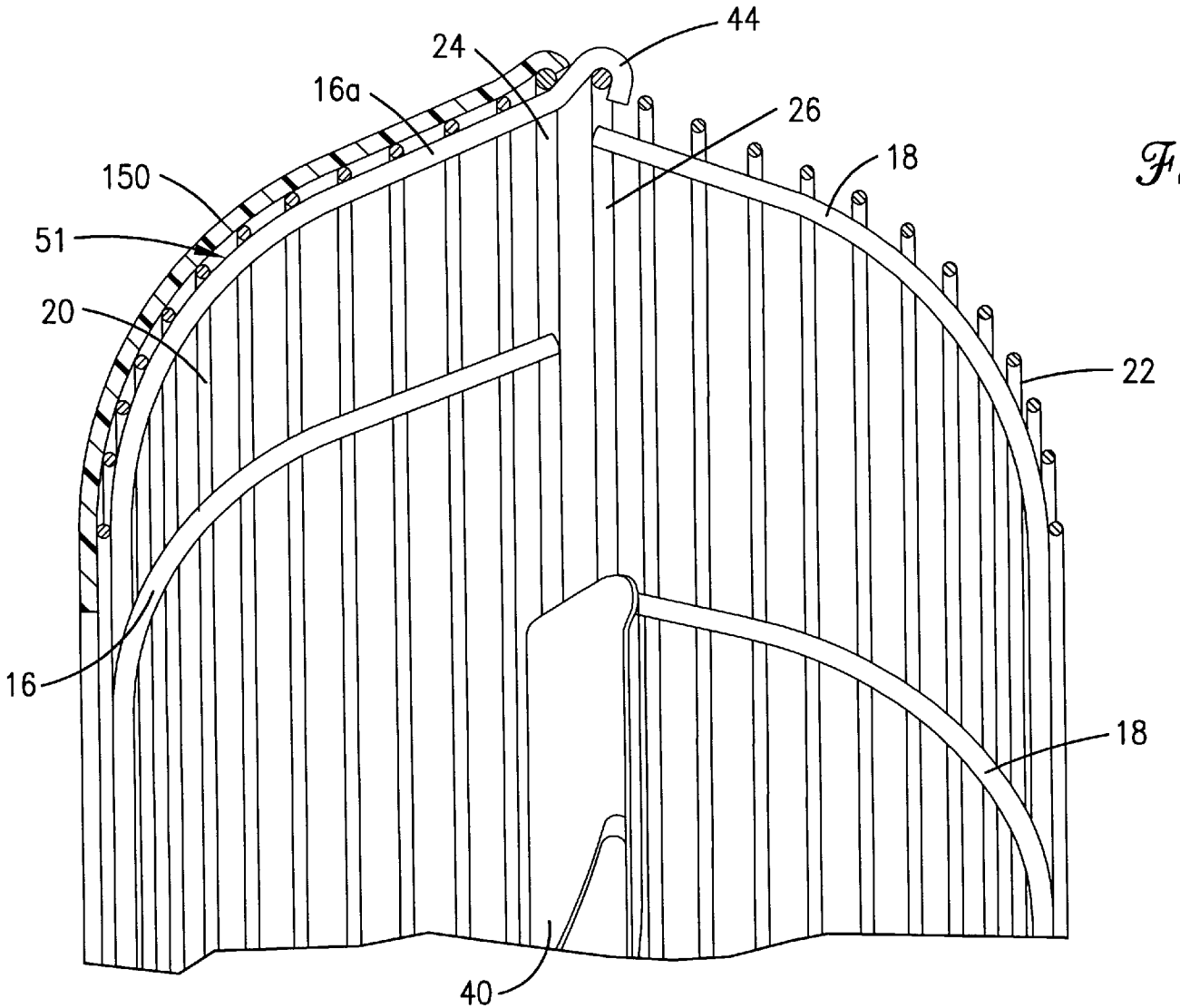
FIG. 5 is an enlarged, fragmentary, cross-sectional view illustrating an air circulation fan having a removable shroud in accordance with a second embodiment of the present invention.

With reference to FIG. 5, an alternate embodiment of the invention is shown and described. The air circulation fan of the embodiment of the invention illustrated in FIG. 5 has the same components as the air circulation fan of the first embodiment of the invention set forth above, with the exception that the shroud is constructed differently. In the embodiment illustrated in FIG. 5, removable shroud 150 is formed of one integral piece of stretchable material. Particularly, removable shroud 150 is formed from a flexible elastomeric band. For example, removable shroud 150 may be formed of a material that has sound absorbing characteristics, such as foam or rubber, or a combination thereof.

Removable shroud 150 as illustrated in FIG. 5 conforms to the configuration of front fan guard member 12. Removable shroud 150 as illustrated in FIG. 5 is dimensioned so that placement of the shroud 150 on front fan guard member 12 is accomplished by stretching the shroud 150 and releasing it into the position illustrated. The overall dimensions and location of removable shroud 150 illustrated in FIG. 5 are similar to that discussed above with reference to removable shroud 50.

Figure 6:
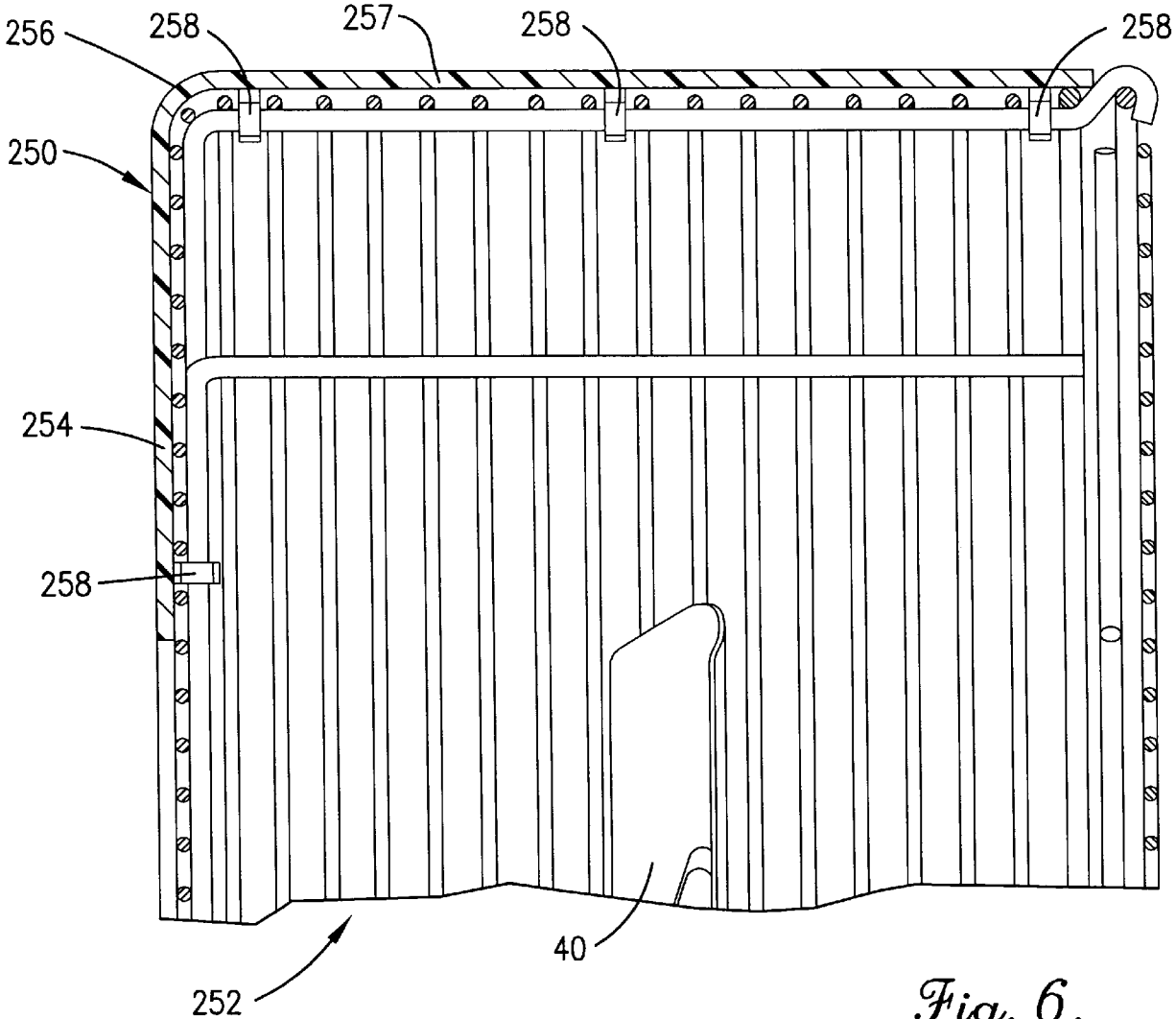
FIG. 6 is an enlarged, fragmentary, cross-sectional view illustrating an alternate shape of the invention.

With reference to FIG. 6, an air circulation fan having a shroud, in accordance with the principles of the present invention, is illustrated wherein the fan has a right circular shape. As illustrated, removable shroud 250 corresponds in shape to the front fan guard member 252, illustrated in FIG. 6. Particularly, removable shroud 250 has a portion 254 which extends inwardly over the face of the front fan guard member from an outer peripheral corner 256 thereof. Removable shroud 250 further has a side portion 257 extending from the corner 256 to a rear of the front fan guard member. As illustrated, portions 254, 257 extend at a right angle with respect to each other.

The shroud 250 defines a central air discharge opening and, as in previously described embodiments, the diameter of the air discharge opening is slightly less than the diameter of an imaginary circle defined by the blade tips when propeller 34 is rotating. In the embodiment illustrated, clips 258, located on shroud 250, serve to releasably secure shroud 250 to front fan guard member 252.

In use, an air circulation fan of the present invention is positioned at a desired location. As discussed above, conventional air circulator fans are often utilized in overhead fans in industrial manufacturing environments. In many such environments, such as in an automobile plant, hundreds or even thousands of fans are located above individual work stations. In such embodiments, the noise generated by the conventional fans is bothersome. Utilization of the air circulation fan of the present invention, having a removable shroud positioned about an outer peripheral portion of the front fan guard member, significantly reduces noise associated with the fan. In this regard, the tip region of each blade is a primary source of noise in conventional air circulation fans. By incorporating a removable shroud with the fan, the tip region of each blade is prohibited from significantly interacting with the downstream region of the air flow domain produced by the fan, thus reducing the noise generated by the fan. Moreover, tests have shown that the velocity, pressure and throw width of air produced by the fan of the present invention, with the shroud in place, is greater than these characteristics produced by the fan with the shroud removed.

Figure 8:
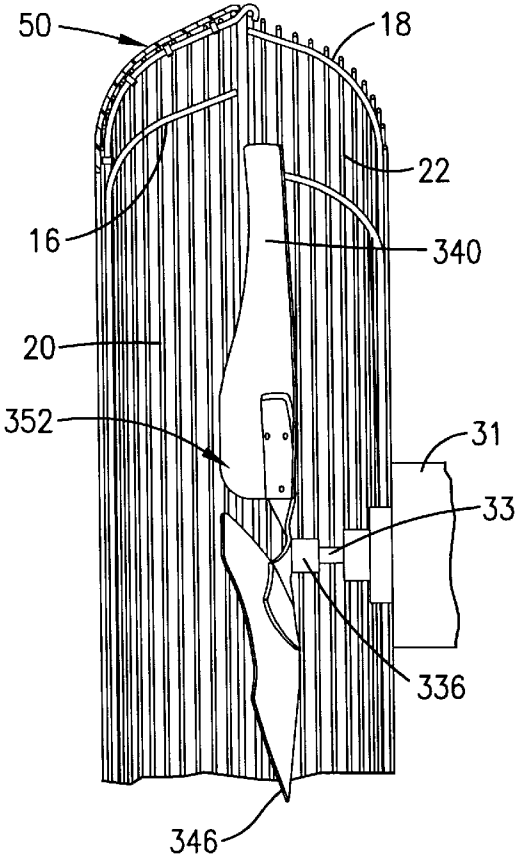
FIG. 8 is a partial side view of the fan illustrated in FIG. 7.
Figure 7:
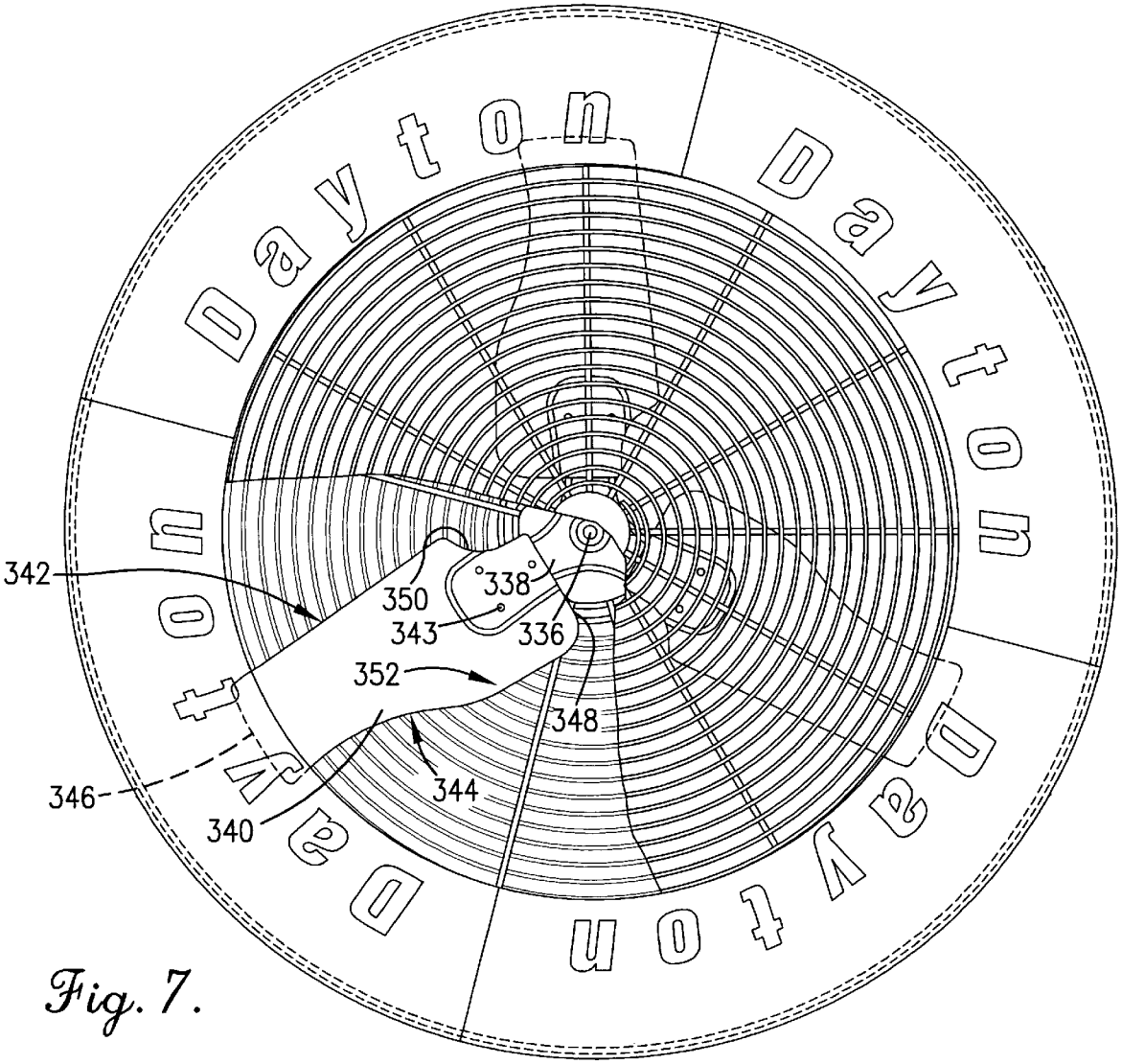
FIG. 7 is a front view of the air circulation fan having a different blade assembly.

With reference now to FIGS. 7 and 8, an alternate embodiment of the present invention is illustrated and described. In the embodiment of FIGS. 7 and 8, the air circulator fan components, including the shroud, are generally the same as those illustrated and described in conjunction with the foregoing embodiments of the invention, with one notable exception. In the embodiments of FIGS. 7 and 8, fan blades 340 are of a type conventionally utilized on box-type poultry fans. These blades are much larger and heavier than the conventional rectangular shaped blades illustrated above in conjunction with FIGS. 1–6. More specifically, each fan blade 340 has a leading edge 342 and a trailing edge 344. Each fan blade 340 has an outer edge 346, and an inner edge 348. Each fan blade 340 is fastened to a corresponding wing 338 of a central hub 336, as illustrated. Attachment of each blade 340 to its corresponding wing 338 is made utilizing fasteners 343.

Particularly, each blade 340 is preferably of a type such as manufactured by Revcor as part No. 5-02767. Each blade 340 has a cut-away notch portion 350 at an inner, leading edge thereof. Furthermore, each blade 340 has a flared portion 352 at an inner, trailing portion thereof with such blades, the centerline at the inlet region of the fan 10 is not void of a velocity profile. Such blades are particularly useful for stirring air and cooling the fan motor. The presence of a shroud of the present invention permits these blades 340 to be utilized, because the shroud causes the air to sufficiently cool the one-half horsepower motor to permit use of these blades 340.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A fan comprising:

a front fan guard member having an outer peripheral portion;

a motor;

a propeller connected to said motor, said propeller positioned behind said front fan guard member; and a removable shroud positioned at said outer peripheral portion of said front fan guard member, wherein said shroud conforms to a contour of said front fan guard member, and wherein said removable shroud forms an annular ring having a central opening, said opening being positioned generally centrally on a face portion of said front fan guard member.

2. The fan as set forth in claim 1, wherein said front fan guard member is constructed in the form of a grill.

3. The fan as set forth in claim 1, further comprising a rear fan guard member.

4. The fan as set forth in claim 1, wherein said removable shroud is comprised of an integral piece of stretchable material.

5. The fan as set forth in claim 1, wherein said removable shroud is comprised of a plurality of identically formed shroud elements.

6. The fan as set forth in claim 5, wherein each said shroud element has at least one clip for clipping to said front fan guard member.

7. The fan as set forth in claim 1, wherein said outer peripheral portion of said front fan guard member includes an outer peripheral rim defining a first area, wherein said central opening in said annular ring defines a second area, and wherein said second area is smaller than said first area.

8. The fan as set forth in claim 7, wherein a third area is defined by a path of rotation of an outer periphery of said propeller, and wherein said third area is closer in size to said first area than to said second area.

9. The fan as set forth in claim 1, wherein said shroud overlies said front fan guard member.

10. A removable shroud positioned at an outer peripheral portion of a front fan guard member, the outer peripheral portion forming a contour, said shroud comprising a shroud member, wherein said shroud member conforms to the contour of the front fan guard member, and wherein said removable shroud forms an annular ring having a central opening, said opening being positioned generally centrally on a face portion of said front fan guard member.

11. The removable shroud as set forth in claim 10, wherein said shroud member is comprised of an integral piece of stretchable material.

12. The removable shroud as set forth in claim 10, wherein said shroud member is comprised of a plurality of identically formed shroud elements.

13. The removable shroud as set forth in claim 12, wherein each said shroud element has at least one clip for clipping to the front fan guard member.

14. The removable shroud as set forth in claim 10, wherein the outer peripheral portion of the front fan guard member includes an outer peripheral rim defining a first area, wherein said central opening in said annular ring defines a second area, and wherein said second area is smaller than said first area.

15. The removable shroud as set forth in claim 10, wherein said shroud overlies the front fan guard member.

16. A fan comprising:

a front fan guard member having an outer peripheral portion;

a motor;

a propeller connected to said motor, said propeller positioned behind said front fan guard member; and a removable shroud having a shape and positioned proximate to said outer peripheral portion of said front fan guard member, wherein said shape of said shroud is at least substantially in conformity with a contour of said front fan guard member, wherein said removable shroud forms an annular ring having a central opening, said opening being positioned generally centrally on a face portion of said front fan guard member such that said shroud affects air flow through said fan when said fan is in operation.

17. A removable shroud positioned at an outer peripheral portion of a front fan guard member of a fan, the outer peripheral portion forming a contour, said shroud comprising a shroud member having a shape, wherein the shape of said shroud member is at least substantially in conformity with the contour of the front fan guard member, wherein said removable shroud forms an annular ring having a central opening, said opening being positioned generally centrally on a face portion of said front fan guard member such that said shroud affects air flow through the fan when the fan is in operation.

* * * * *